US009228735B2

(12) United States Patent
Liu

(10) Patent No.: US 9,228,735 B2
(45) Date of Patent: Jan. 5, 2016

(54) DISPLAY STAND

(71) Applicant: DIODE-ON OPTOELECTRONICS LIMITED, Taichung (TW)

(72) Inventor: Ivan Liu, Taichung (TW)

(73) Assignee: Diode-On Optoeletronics Limited, Taichung (TW)

( * ) Notice: Subject to any disclaimer, the term of this patent is extended or adjusted under 35 U.S.C. 154(b) by 142 days.

(21) Appl. No.: 14/189,756

(22) Filed: Feb. 25, 2014

(65) Prior Publication Data

US 2015/0092397 A1 Apr. 2, 2015

(30) Foreign Application Priority Data

Oct. 2, 2013 (TW) ..... 102135696 A

(51) Int. Cl.

| | |
|---|---|
| ***F21V 33/00*** | (2006.01) |
| ***A47F 3/00*** | (2006.01) |
| ***A47F 11/10*** | (2006.01) |
| ***F21K 99/00*** | (2010.01) |
| ***F21S 4/00*** | (2006.01) |
| ***F21S 8/06*** | (2006.01) |
| ***F21V 21/35*** | (2006.01) |
| ***F21V 23/04*** | (2006.01) |
| *F21W 131/301* | (2006.01) |
| *F21Y 101/02* | (2006.01) |

(52) U.S. Cl.

CPC ..... *F21V 33/0012* (2013.01); *A47F 3/001* (2013.01); *A47F 11/10* (2013.01); *F21K 9/30* (2013.01); *F21S 4/008* (2013.01); *F21S 8/066* (2013.01); *F21V 21/35* (2013.01); *F21V 23/045* (2013.01); *F21V 23/0471* (2013.01); *F21V 23/0485* (2013.01); *A47B 2220/0077* (2013.01); *F21W 2131/301* (2013.01); *F21Y 2101/02* (2013.01)

(58) Field of Classification Search

CPC . F21V 33/0012; F21V 21/35; F21V 23/0471; F21V 23/0485; F21V 23/045; F21K 9/30; F21S 4/008; F21S 8/066; F21W 213/301; F21Y 2101/02; A47F 3/001; A47F 11/10; A47B 2220/0077

See application file for complete search history.

(56) References Cited

U.S. PATENT DOCUMENTS

| | | | | |
|---|---|---|---|---|
| 6,231,205 | B1 * | 5/2001 | Slesinger | A47B 96/02 362/125 |
| 2003/0015945 | A1 * | 1/2003 | Vandenbussche | A47F 3/001 312/114 |
| 2011/0051401 | A1 * | 3/2011 | Bauer | F21S 4/008 362/125 |
| 2011/0096533 | A1 * | 4/2011 | Sekela | A47F 3/001 362/125 |

* cited by examiner

*Primary Examiner* — Mary Ellen Bowman
(74) *Attorney, Agent, or Firm* — LeClairRyan

(57) ABSTRACT

A display stand includes a frame body and several illuminating support plate units. The frame body has several spaced-apart plate-mounting portions, and several power supply portions respectively adjacent to the plate-mounting portions. Each illuminating support plate unit includes a plate body coupled removably to one plate-mounting portion, an illuminating unit mounted on the plate body, and an electric connecting unit having a base portion that is embedded in the plate body, and an electric connecting portion that is disposed within a range defined between extensions of upper and lower surfaces of the plate body, and that is connected electrically to a corresponding one of the power supply portions.

14 Claims, 14 Drawing Sheets

DISPLAY STAND

CROSS-REFERENCE TO RELATED APPLICATION

This application claims priority of Taiwanese Patent Application No. 102135696, filed on Oct. 2, 2013.

BACKGROUND OF THE INVENTION

1. Field of the Invention

The invention relates to a display stand, more particularly to a display stand with illuminating support plate units.

2. Description of the Related Art

As shown in FIG. 1, a conventional display stand 1 includes a bottom board 11, a top board 12, two side boards 13, each of which is connected to a side of the bottom board 11 and a side of the top board 12, a back board 14 connected to the bottom, top and side boards 11, 12, 13, and a plurality of support boards 15 disposed spacedly from the bottom board 11 to the top board 12. Each of the support boards 15 has a topside for placing objects (not shown) for display. In practice, in order to promote an overall exhibiting effect of the displayed objects, illuminating devices 16 such as fluorescent lights, light projecting lamps, etc., are usually mounted directly on a bottom side of the support boards 15 and the top board 12 to brighten the displayed objects. Each of the support boards 15 can be separately mounted to the side boards 13, such that the distances between two adjacent support boards 15, between each support board 15 and the top board 12, and between each support board 15 and the bottom board 11 can be easily adjusted to display objects having different heights.

As such, power wires 161 of the illuminating devices 16 for electrical connection with an external power supply cannot be directly embedded in the display stand 1 (which is how it is done in an integrally formed display stand), and must run visibly from the illuminating devices 16 to a socket 17 on the back board 14. Not only do the power wires 161 need to be rearranged with rearrangement of the support boards 15, but exposure of the same also lowers the overall aesthetics of the conventional display stand 1.

SUMMARY OF THE INVENTION

Therefore, the object of the present invention is to provide a display stand that can eliminate the aforesaid drawbacks of the prior art.

According to the present invention, there is provided a display stand including a frame body and a plurality of illuminating support plate units.

The frame body has a plurality of spaced-apart plate-mounting portions, and a plurality of power supply portions that are respectively adjacent to the plate-mounting portions.

Each of the illuminating support plate units includes a plate body, an illuminating unit, a control circuit and an electric connecting unit. The plate body is coupled removably to one of the plate-mounting portions of the frame body. The illuminating unit is mounted on the plate body. The control circuit is mounted within the plate body and electrically connected to the illuminating unit. The electric connecting unit is mounted on the plate body.

The electric connecting unit has a base portion and an electric connecting portion. The base portion is embedded in the plate body and is electrically connected to the control circuit. The electric connecting portion is electrically connected to the base portion, is disposed within a range defined between extensions of upper and lower surfaces of the plate body, and has a distal end connected electrically to a corresponding one of the power supply portions.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
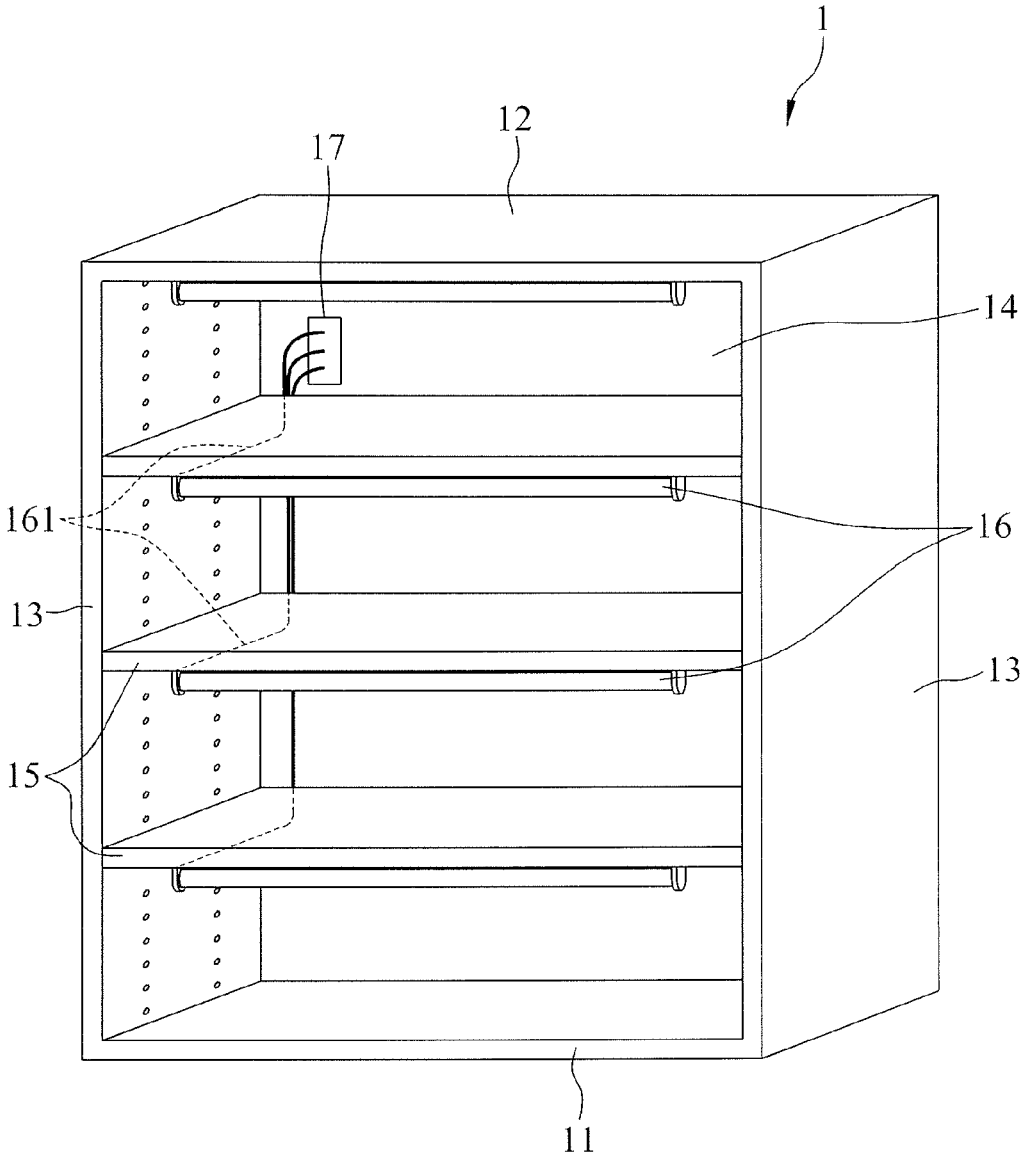
FIG.1 PRIOR ART
FIG. 1 is a perspective view of a conventional display stand.

Before the present invention is described in greater detail, it should be noted that like elements are denoted by the same reference numerals throughout the disclosure.

Figure 2:
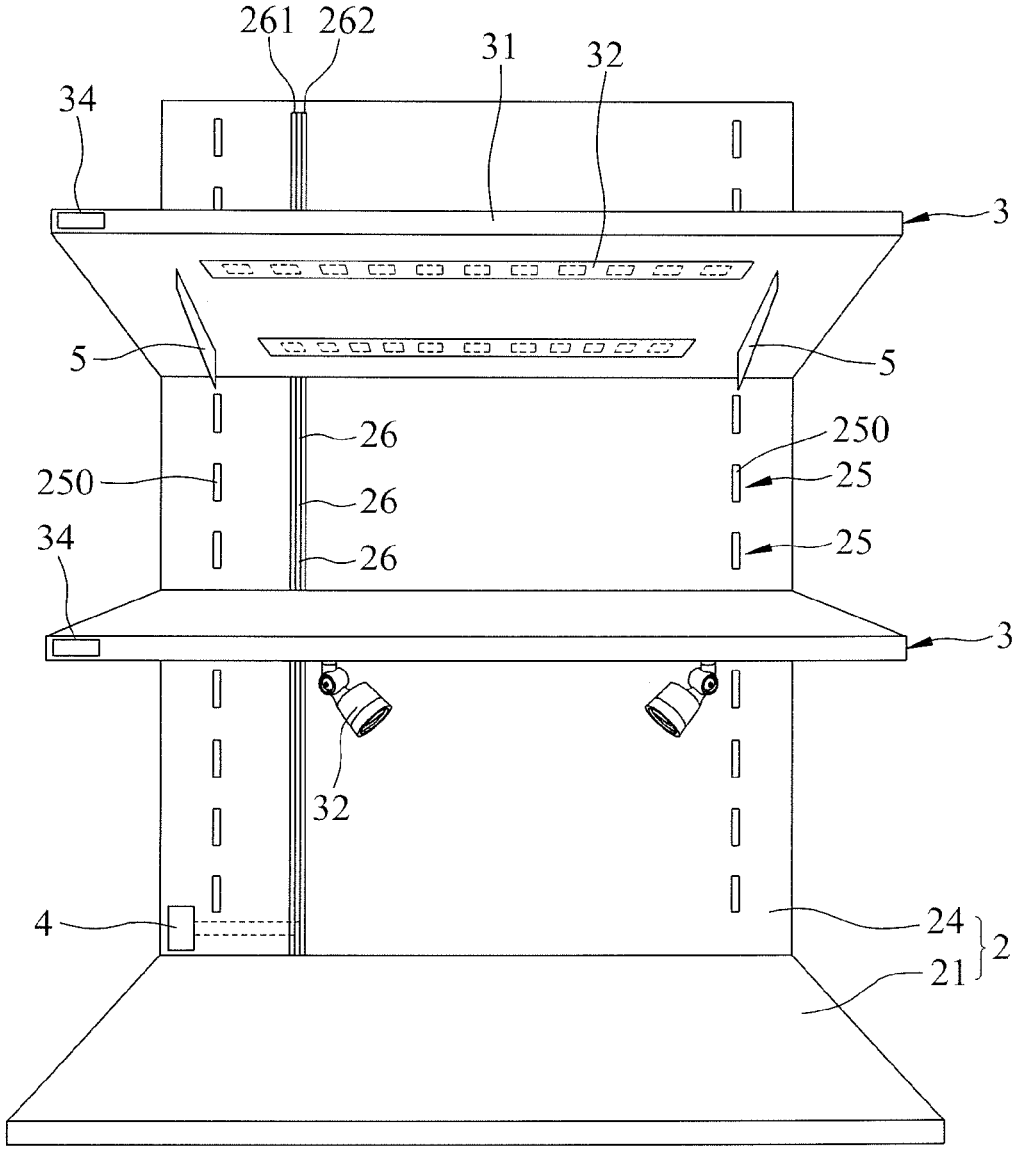
FIG. 2 is a perspective view of the first preferred embodiment of a display stand according to the present invention.
Figure 3:
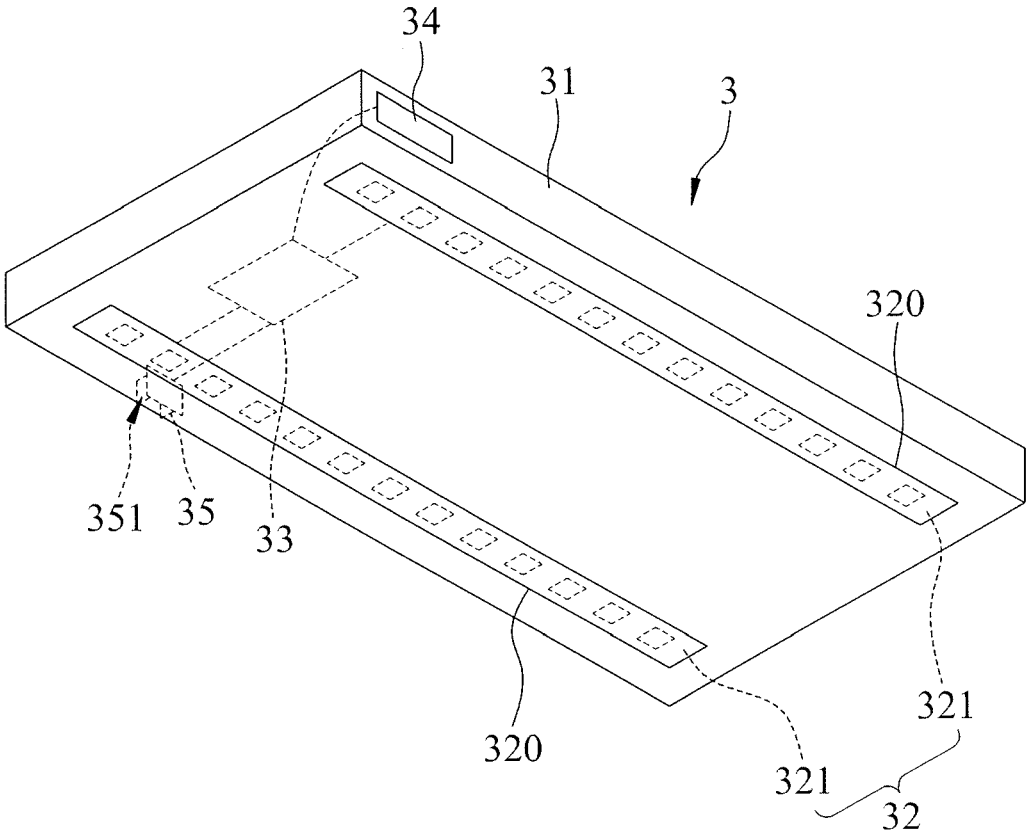
FIG. 3 is a perspective view of an illuminating support plate unit of the first preferred embodiment.

Referring to FIGS. 2 and 3, the first preferred embodiment of a display stand according to the present invention includes a frame body 2, a plurality of illuminating support plate units 3 and a power switch 4.

The frame body 2 includes a bottom plate 21, and a back plate 24 extending upward from a rear edge of the bottom plate 21. The frame body 2 has a plurality of spaced-apart plate-mounting portions 25, and a plurality of power supply portions 26 that are respectively adjacent to the plate-mounting portions 25. The plate-mounting portions 25 are formed in the back plate 24 and are spaced apart from each other in a top-bottom direction. Each of the plate-mounting portions 25 has a pair of spaced-apart insertion holes 250 that correspond in height to each other. Each of the power supply portions 26 is adapted to be electrically connected to a direct-current (DC) power source (not shown) having a low output voltage (not exceeding 25 volts), and is mounted on the back plate 24 in correspondence to the respective one of the plate-mounting portions 25. In this embodiment, the power supply portions 26 are electrically connected to one another, are formed in the back plate 24 and cooperatively define first and second power supply rails 261, 262 extending in the top-bottom direction, and are adapted to be connected to an anode and a cathode of the DC power source. The output voltage of the DC power source is the voltage difference between the cathode and the anode, which is 12 volts in this embodiment.

Each of the illuminating support plate units 3 includes a plate body 31, an illuminating unit 32, a control circuit 33, an illuminating control unit 34 and an electric connecting unit 35. The plate body 31 is coupled removably to one of the plate-mounting portions 25 of the frame body 2. The illuminating unit 32 is mounted on the plate body 31. The control circuit 33 is mounted within the plate body 31 and electrically connected to the illuminating unit 32. The illuminating control unit 34 is mounted on the plate body 31 and is electrically connected to the control circuit 33. The electric connecting unit 35 is mounted on the plate body 31. Each of the illuminating support plate units 3 further includes a pair of support members 5 that support the plate body 31 on the frame body 2, and that engage respectively the insertion holes 250 of the corresponding one of the plate-mounting portions 25.

Figure 4:
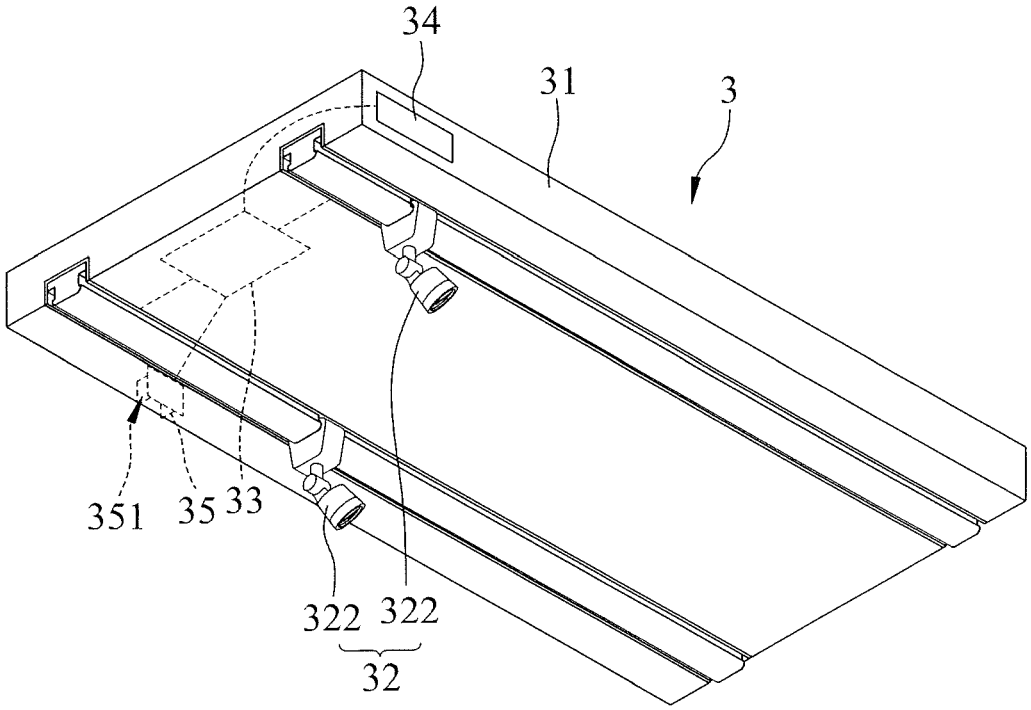
FIG. 4 is a perspective view of aspect different implementation of the illuminating support plate unit of the first preferred embodiment.
Figure 5:
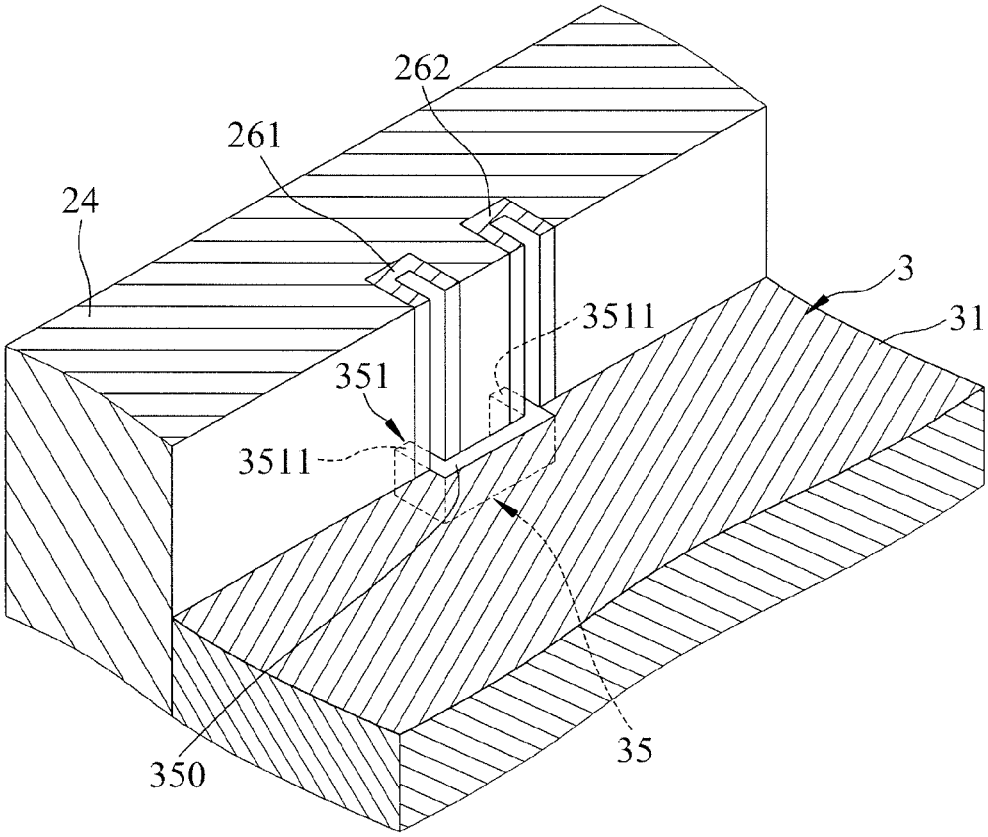
FIG. 5 is a fragmentary sectional view of an electric connecting unit of the illuminating support plate unit and a frame body of the first preferred embodiment.

In this embodiment, one type of illuminating unit 32 includes a pair of LED light strips 321 (see FIG. 3) which are embedded in one side of the plate body 31 and each of which is covered by a light-diffusing plate 320. Another type of illuminating unit 32 includes a pair of track lights 322 (see FIG. 4), each of which is slidable along a track that is mounted on one side of the plate body 31. It is worth mentioning that, the illuminating unit 32 may also include spotlights, panel lights, and/or any light source having adjustable color and brightness, which may be combined to satisfy any illuminating requirement. The illuminating control unit 34 of each support plate unit 3 is used for controlling the illuminating intensity and the illuminating color of the illuminating unit 32 and for turning on and off the illuminating unit 32. The illuminating control unit 34 is configured as one of a physical button, a touch sensor, an infrared sensor and a wireless remote control sensor. As shown in FIG. 5, the electric connecting unit 35 has a base portion 350 and an electric connecting portion 351. The base portion 350 is embedded in the plate body 31 and is electrically connected to the control circuit 33. The electric connecting portion 351 is electrically connected to the base portion 350, is disposed within a range defined between extensions of upper and lower surfaces of the plate body 31, and has a distal end that is relatively proximate to the plate body 31 and that is electrically connected to the corresponding one of the power supply portions 26. The electric connecting portion 351 has a pair of contact pieces 3511 connected electrically and respectively to the first and second power supply rails 261, 262.

The power switch 4 is mounted on the back plate 24 of the frame body 2, is electrically connected to the power supply portions 26 and is adapted to be electrically connected to the DC power source. The power switch 4, the power supply portions 26, the electronic connecting unit 35, the control circuit 33 and the illuminating control unit 34 cooperate to forma circuit for power delivery to the illuminating unit 32. The power switch 4 is configured as one of a physical button, a touch sensor, an infrared sensor and a wireless remote control sensor.

When each of the illuminating support plate units 3 is mounted on the frame body 2 through coupling of a corresponding one of the plate-mounting portions 25, the electric connecting portion 351 of the electric connecting unit 35 is automatically electrically connected to one of the power supply portions 26, (i.e.

each contact piece 3511 of the electric connecting portion 351 is connected electrically to a respective one of the first and second power supply rails 261, 262) (see FIG. 5) so as to be electrically connected to the DC power source. From this description, it is evident that the wires of the illuminating unit 32, the control circuit 33 and the electric connecting unit 35 are embedded concealingly in the plate body 31 of each of the illuminating support plate units 3; therefore, the overall appearance of the display stand is clean and neat. Moreover, since the electric connecting portion 351 of the electric connecting unit 35 is automatically in electrical connection with a power supply portion 26 once the illuminating support plate unit 3 is coupled to one of the plate-mounting portions 25 so as to be electrically connected to the DC power source, rewiring to establish electrical connection between the DC power source and the illuminating support plate unit 3 is no longer needed each time an illuminating support plate unit 3 is redisposed to a different plate-mounting portion 25 of the frame body 2.

Figure 6:
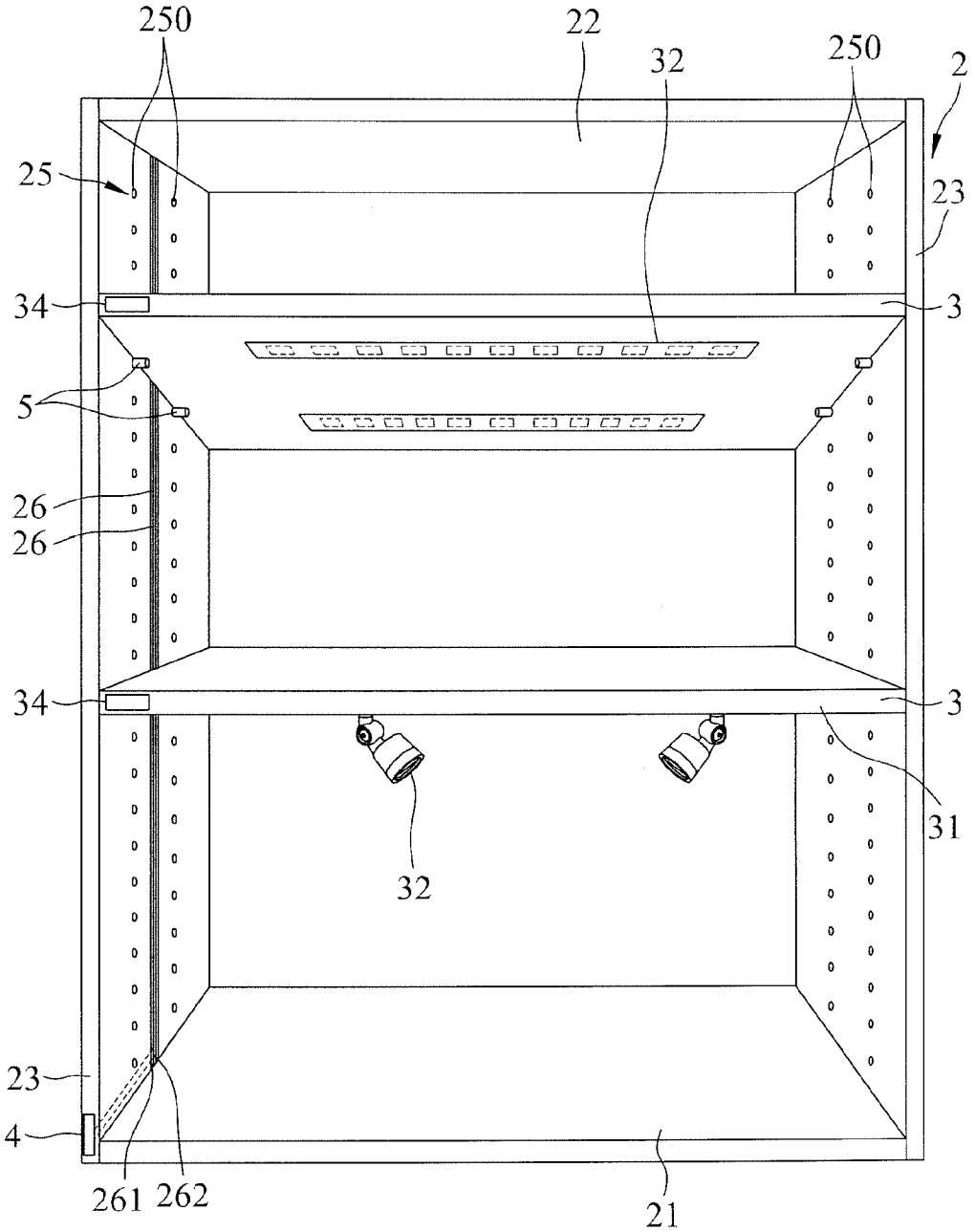
FIG. 6 is a perspective view of the second preferred embodiment of a display stand according to the present invention.
Figure 7:
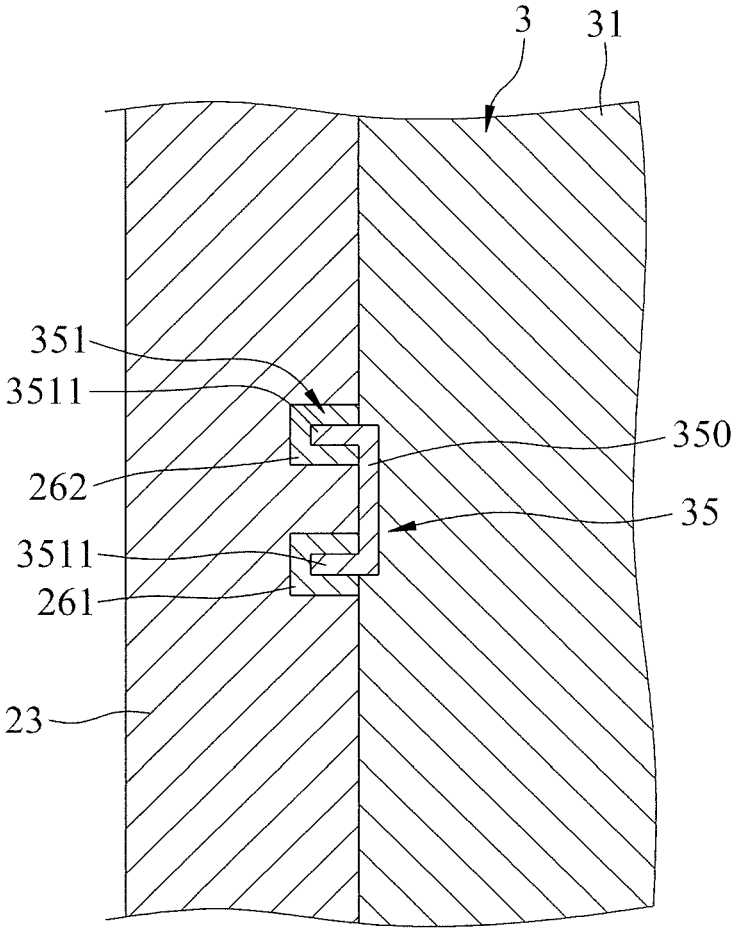
FIG. 7 is a fragmentary sectional view of an electric connecting unit of the illuminating support plate unit and a frame body of the second preferred embodiment.

Referring to FIGS. 6 and 7, the second preferred embodiment of a display stand according to the present invention is similar to the first preferred embodiment in structure, and only differs in that in place of the back plate 24 (see FIG. 2) the frame body 2 includes two side plates 23 spaced apart from each other in a left-right direction. Each of the side plates 23 is connected to a respective one of opposite lateral edges of the bottom plate 21 and a respective one of opposite lateral edges of the top plate 22. In this embodiment, each of the plate-mounting portions 25 includes two pairs of insertion holes 250 that correspond in height to each other. Each pair of insertion holes 250 is formed in a respective one of the side plates 23. Each of the illuminating support plate units 3 further includes a plurality of support members 5 that support the plate body 31 on the frame body 2. The support members 5 respectively engage the insertion holes 250 of one of the plate-mounting portions 25. The power supply portions 26 are formed in one of the side plates 23 and cooperatively define the first and second power supply rails 261, 262 (see FIG. 6) which extend in the top-bottom direction, and which are adapted to be connected respectively and electrically to an anode and a cathode of the DC power source. The electric connecting portion 351 of the electric connecting unit 35 has a pair of contact pieces 3511 connected electrically to the first and second power supply rails 261, 262 (see FIG. 7).

Figure 8:
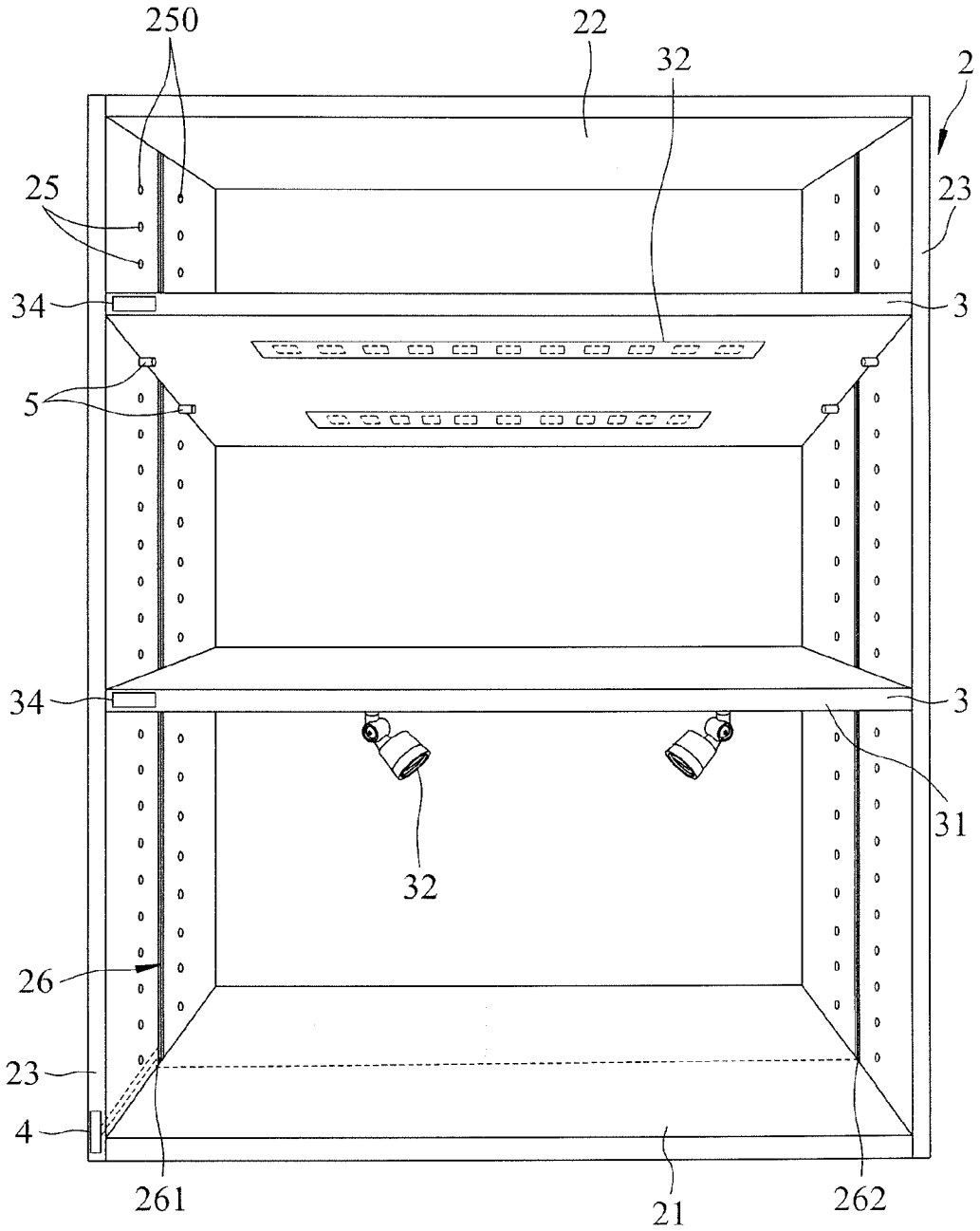
FIG. 8 is a perspective view of aspect different implementation of the second preferred embodiment.
Figure 9:
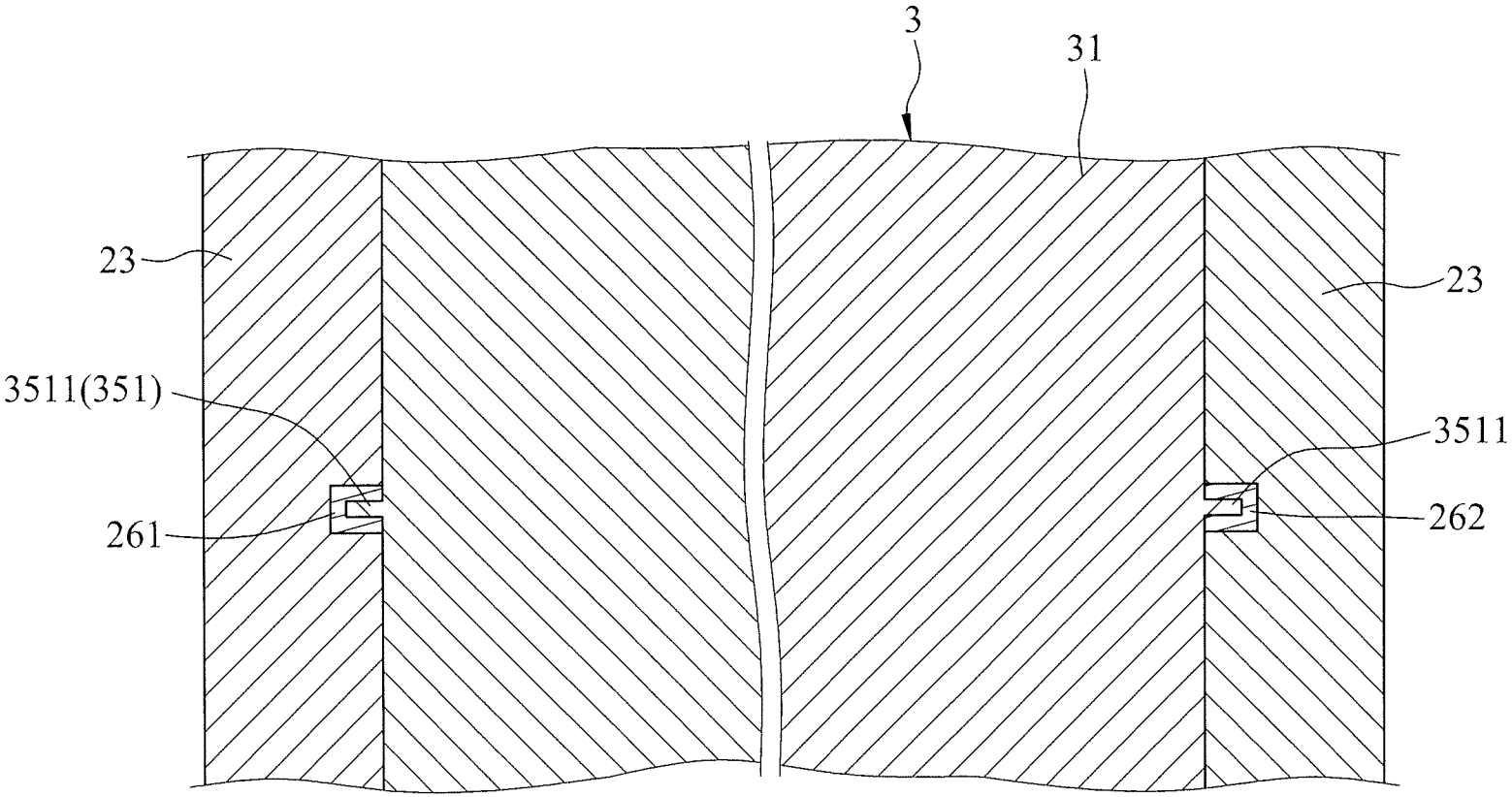
FIG. 9 is a fragmentary sectional view of an electric connecting unit of the illuminating support plate unit and a frame body of the implementation shown in FIG. 8.

Alternatively, in another implementation of the second preferred embodiment where the power supply portions 26 are formed in both of the side plates 23 (see FIG. 8), to cooperatively define the first and second power supply rails 261, 262 symmetrically and respectively disposed on the side plates 23, when any of the illuminating support plate units 3 is vertically or horizontally turned 180 degrees before mounting on the frame body 2, the contact pieces 3511 of the electric connecting portion 351 of the electric connecting unit 35 can still automatically be electrically and respectively connected to the first and second power supply rails 261, 262 (see FIG. 9) for electrical connection to the DC power source.

It is worth mentioning here that, the bottom plate 21 and/or the top plate 22 may as well be configured as an illuminating support plate unit 3 to provide more display options. In view of the above, the second preferred embodiment achieves the same effect as the first preferred embodiment.

Figure 10:
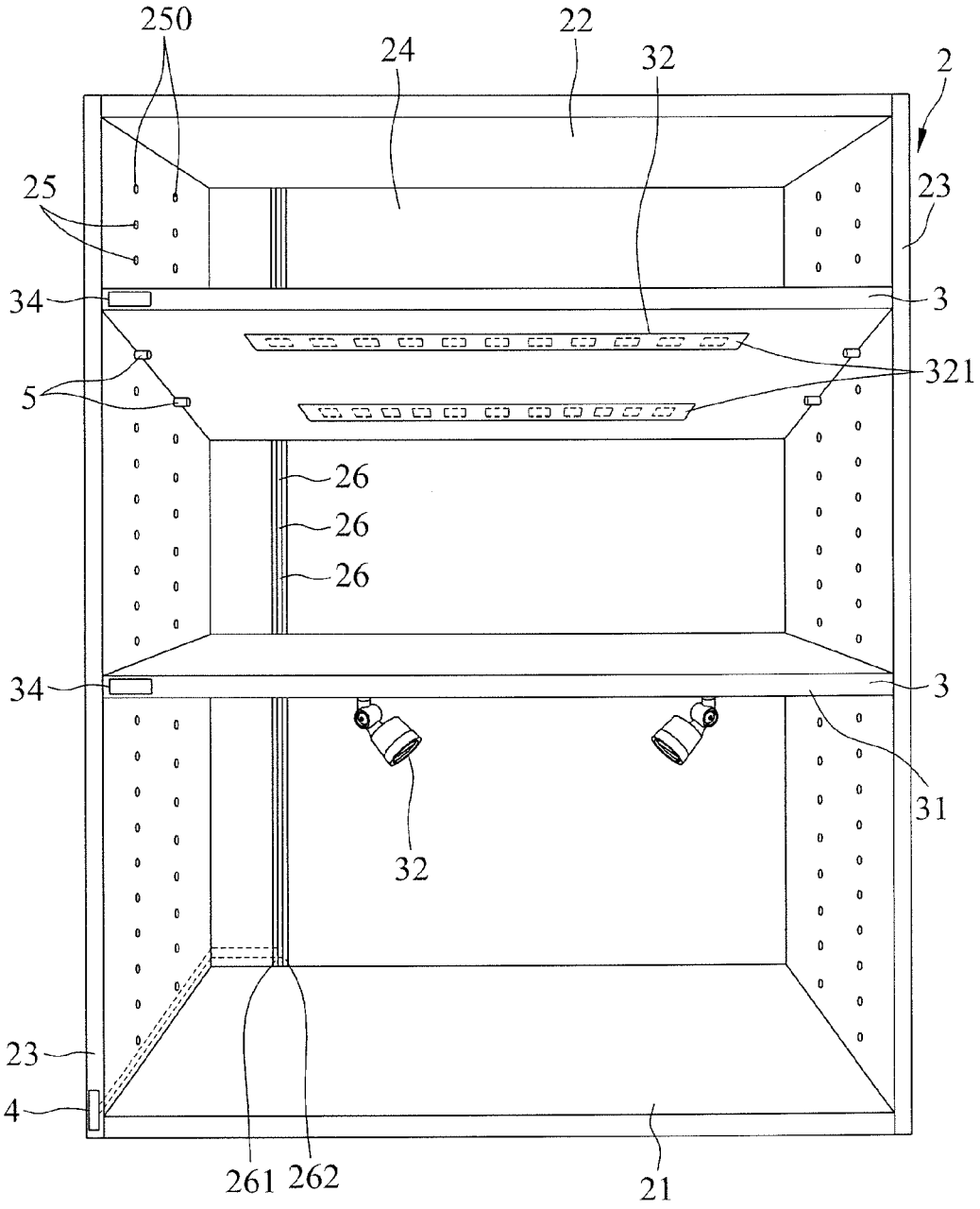
FIG. 10 is a perspective view of the third preferred embodiment of a display stand according to the present invention.
Figure 11:
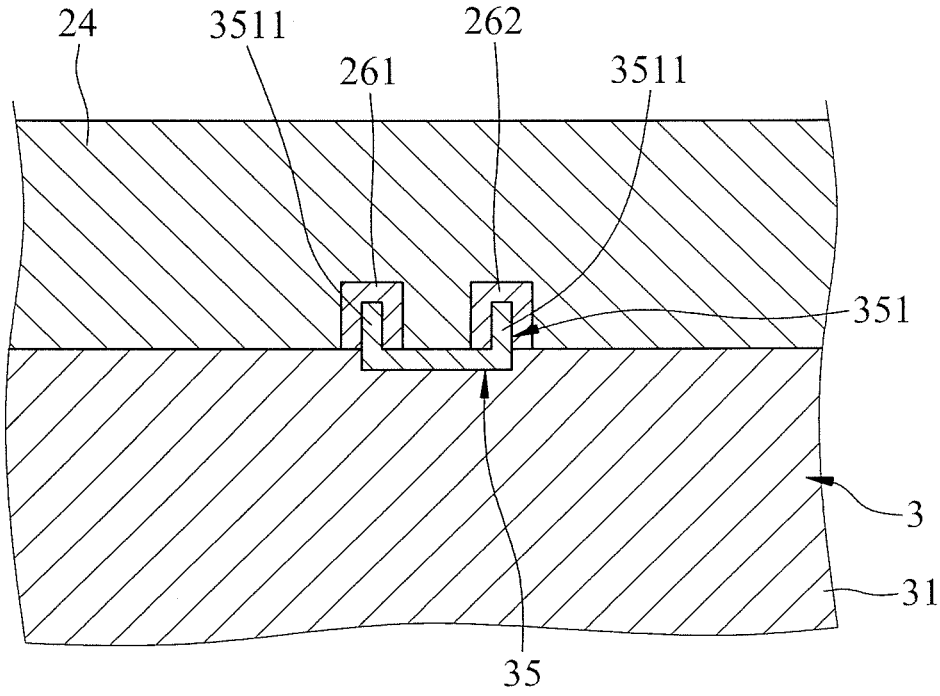
FIG. 11 is a fragmentary sectional view of an electric connecting unit of the illuminating support plate unit and a frame body of the third preferred embodiment.
Figure 12:
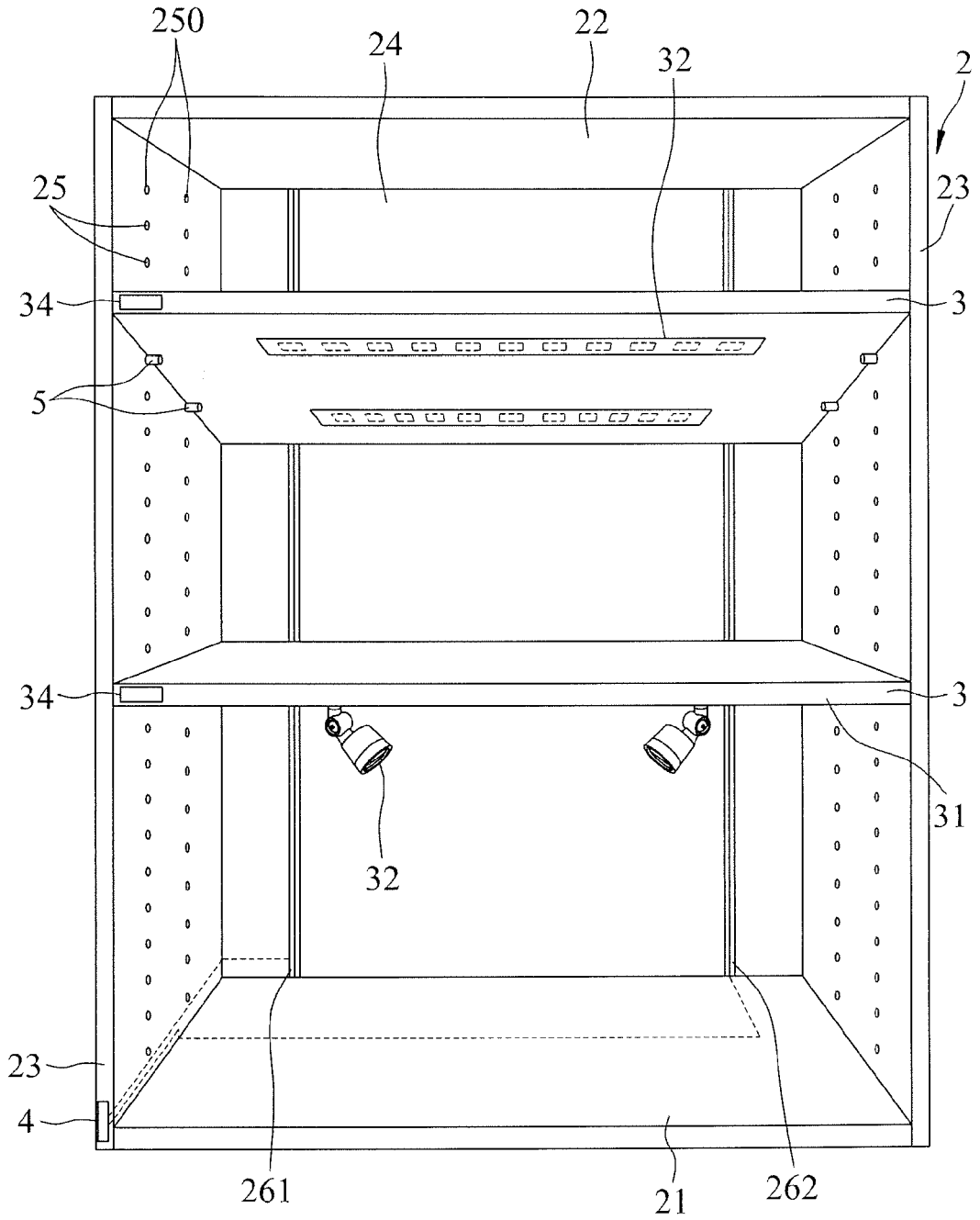
FIG. 12 is a perspective view of aspect different implementation of the third preferred embodiment.
Figure 13:
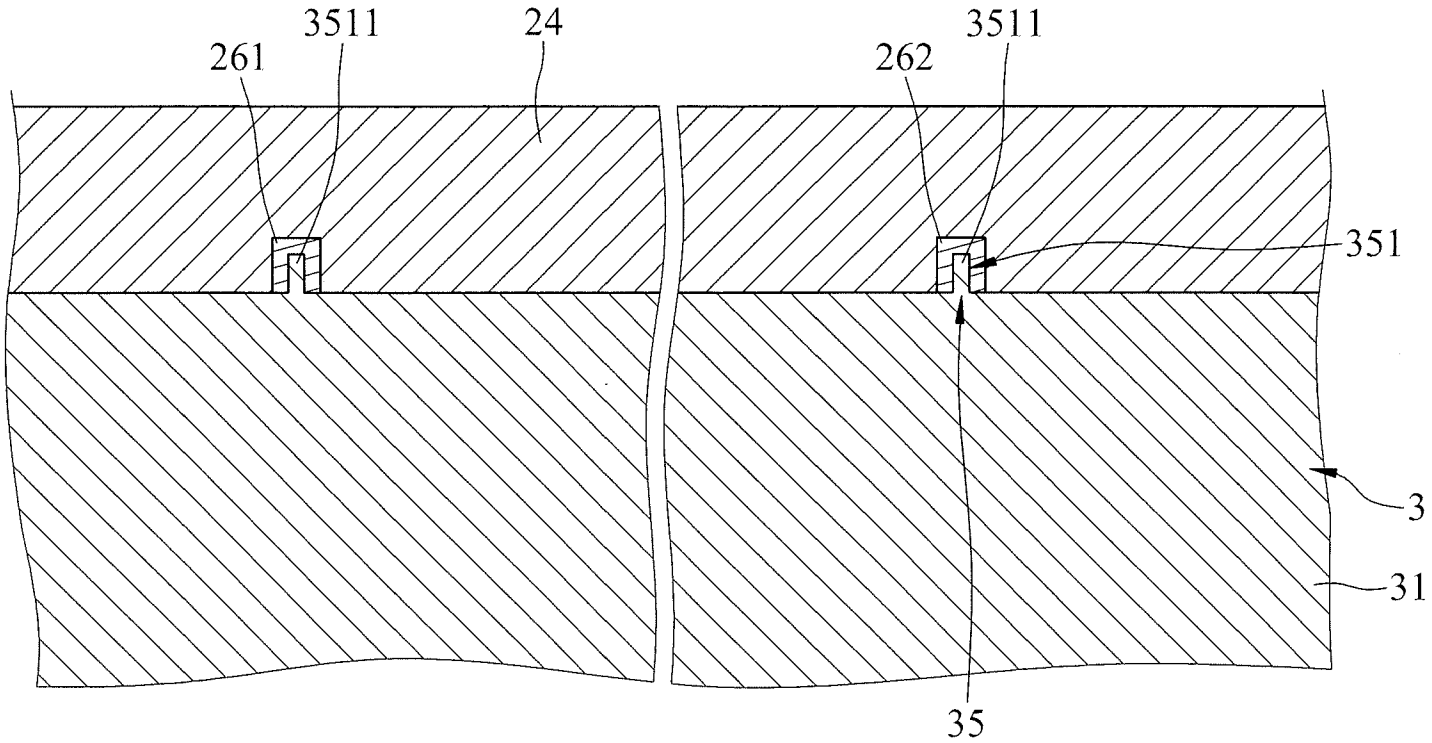
FIG. 13 is a fragmentary sectional view of an electric connecting unit of the illuminating support plate and a frame body of the implementation shown in FIG. 12.
Figure 14:
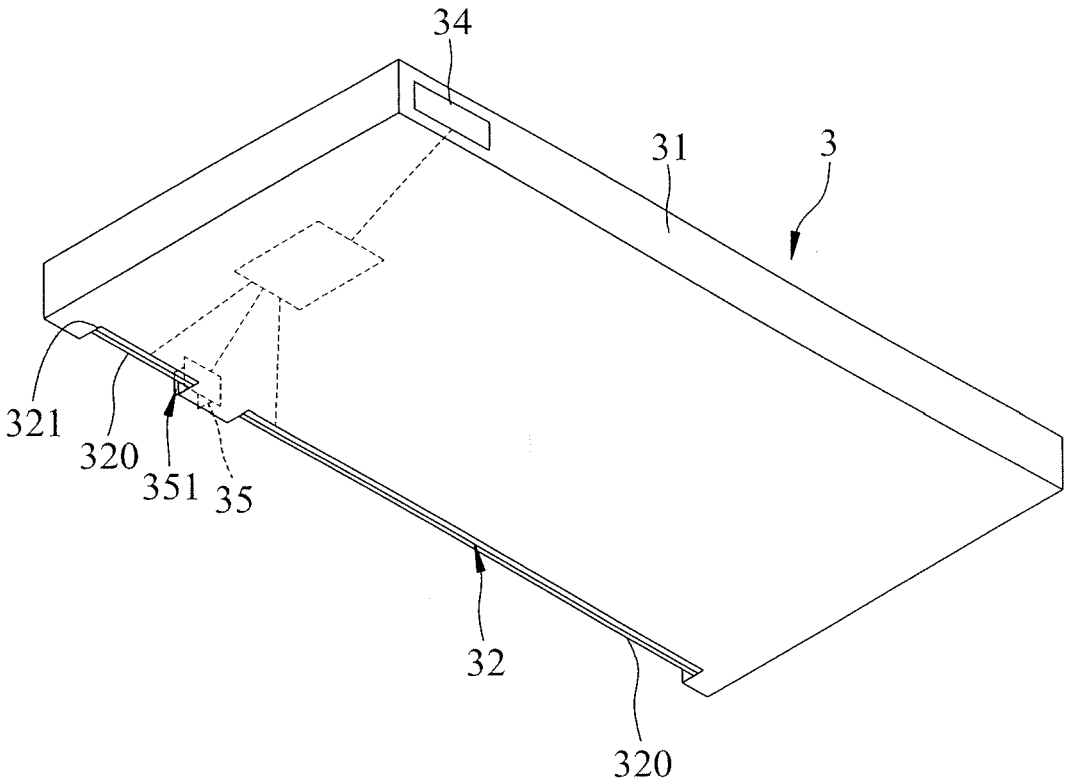
FIG. 14 is a perspective view of a variation of the illuminating support plate unit of the third preferred embodiment.

Referring to FIGS. 10 and 12, the third preferred embodiment of a display stand according to the present invention is similar to the second preferred embodiment in structure and differs in that the frame body 2 further includes a back plate 24. The power supply portions 26 are formed in the back plate 24 and cooperatively define first and second power supply rails 261, 262 extending in the top-bottom direction. The first and second power supply rails 261, 262 are adapted to be connected to an anode and a cathode of the DC power source. It is worth mentioning that, the first and second power supply rails 261, 262 can be adjacently disposed (see FIG. 10) or spacedly disposed (see FIG. 12) from each other. The contact pieces 3511 of the electric connecting portion 351 of the electric connecting unit 35 of each illuminating support plate unit 3 are electrically and respectively connected to the first and second power supply rails 261, 262 of the corresponding power supply portion 26 (see FIGS. 11 and 13). Moreover, the LED light strip 321 of the illuminating unit 32 may be mounted on a periphery of the plate body 31 and may be covered by a light-diffusing plate 320 (see FIG. 14) if required. The third preferred embodiment achieves the same effect as the first preferred embodiment.

In sum, the advantages of the present invention are as follows.

A) Since the wires of the illuminating unit 32, the control circuit 33 and the electric connecting unit 35 are embedded within each of the illuminating support plate units 3 (hence not exposed), the overall appearance of the display stand is clean and neat.

B) Since the electric connecting portions 351 of the electric connecting unit 35 are automatically connected to one of the power supply portions 26 so as to be electrically connected to the DC power source when each of the illuminating support plate units 3 is mounted on the frame body 2, rewiring is no longer needed each time an illuminating support plate unit 3 is re-disposed on the plate-mounting portion 25 of the frame body 2.

C) By simple adjustment, the position of the electric connecting units 35 of each of the illuminating support plate units 3 can be easily adapted to be mounted on a frame body 2 having a different structure, to achieve the automatic electric connection with the DC power source once mounted to the frame body 2.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A display stand comprising:

a frame body having a plurality of spaced-apart plate-mounting portions, and a plurality of power supply portions that are respectively adjacent to said plate-mounting portions; and a plurality of illuminating support plate units, each of which includes a plate body coupled removably to one of said plate-mounting portions of said frame body, an illuminating unit mounted on said plate body, a control circuit mounted within the plate body and electrically connected to said illuminating unit, and an electric connecting unit mounted on said plate body, said electric connecting unit has a base portion that is embedded in said plate body and that is electrically connected to said control circuit, and an electric connecting portion that is electrically connected to said base portion, that is disposed within a range defined between extensions of upper and lower surfaces of said plate body, and that has a distal end connected electrically to a corresponding one of said power supply portions.

2. The display stand as claimed in claim 1, wherein said frame body further includes a bottom plate, and a back plate extending upward from a rear edge of said bottom plate, said plate-mounting portions being formed in said back plate and being spaced apart from each other in a top-bottom direction, each of said plate-mounting portions having a pair of spaced-apart insertion holes that correspond in height to each other, each of said illuminating support plate units further including a pair of support members that support said plate body thereon, and that engage respectively said insertion holes of said one of said plate-mounting portions.

3. The display stand as claimed in claim 2, wherein said power supply portions are formed in said back plate and cooperatively define first and second power supply rails extending in the top-bottom direction, and being adapted to be connected respectively and electrically to an anode and a cathode of a direct-current power source, said electric connecting portion of said electric connecting unit having a pair of contact pieces that are connected electrically and respectively to said first and second power supply rails.

4. display stand as claimed in claim 1, wherein said frame body further includes a bottom plate, a top plate, and two side plates spaced apart from each other in a left-right direction, each of said side plates being connected to a respective one of opposite lateral edges of said bottom plate and a respective one of opposite lateral edges of said top plate, said plate-mounting portions being spacedly arranged in a top-bottom direction, each of said plate-mounting portions including two pairs of insertion holes that correspond in height to each other, each pair being formed in a respective one of said side plates, each of said illuminating support plate units further including a plurality of support members that support said plate body thereon, and that engage respectively said insertion holes of said one of said plate-mounting portions.

5. The display stand as claimed in claim 4, wherein said power supply portions are formed in one of said side plates and cooperatively define first and second power supply rails extending in the top-bottom direction, and being adapted to be connected respectively and electrically to an anode and a cathode of a direct-current power source, said electric connecting portion of electric connecting unit having a pair of contact pieces that are connected electrically and respectively to said first and second power supply rails.

6. The display stand as claimed in claim 4, wherein said power supply portions cooperatively define first and second power supply rails in said side plates, respectively, said power supply portions extending in a top-bottom direction and being adapted to be connected respectively and electrically to an anode and a cathode of a direct-current power source, said electric connecting portion of said electric connecting unit having a pair of contact pieces that are connected electrically and respectively to said first and second power supply rails.

7. The display stand as claimed in claim 4, wherein said frame body further includes a back plate connected to said top and bottom plates and said side plates.

8. The display stand as claimed in claim 7, wherein said power supply portions are formed in said back plate and cooperatively define first and second power supply rails extending in the top-bottom direction and being adapted to be connected respectively and electrically to an anode and a cathode of a direct-current power source, said electric connecting portion of said electric connecting unit having a pair of contact pieces that are connected electrically and respectively to said first and second power supply rails.

9. The display stand as claimed in claim 7, wherein said power supply portions are formed in one of said side plates and cooperatively define first and second power supply rails extending in the top-bottom direction, and being adapted to be connected respectively and electrically to an anode and a cathode of a direct-current power source, said electric connecting portion of said electric connecting unit having a pair of contact pieces that are connected electrically and respectively to said first and second power supply rails.

10. The display stand as claimed in claim 7, wherein said power supply portions cooperatively define first and second power supply rails in said side plates, respectively, said power supply portions extending in a top-bottom direction and being adapted to be connected respectively and electrically to an anode and a cathode of a direct-current power source, said electric connecting portion of said electric connecting unit having a pair of contact pieces that are connected electrically and respectively to said first and second power supply rails.

11. The display stand as claimed in claim 1, wherein said illuminating unit includes at least one of a track light, an LED light strip, a spotlight, a panel light, and a light source having adjustable color and brightness.

12. The display stand as claimed in claim 1, wherein said illuminating unit is an LED light strip mounted on the periphery of said plate body of said illuminating support plate.

13. The display stand as claimed in claim 1, further comprising a power switch mounted on said frame body, each of said illuminating support plate units further including an illuminating control unit that is mounted to said plate body of said support plates and that is connected electrically to said control circuit.

14. The display stand as claimed in claim 13, wherein:

said power switch is configured as one of a physical button, a touch sensor, an infrared sensor and a wireless remote control sensor; and said illuminating control unit is configured as one of a physical button, a touch sensor, an infrared sensor and a wireless remote control sensor.

* * * * *